US009302521B2

(12) United States Patent
Bennett

(10) Patent No.: US 9,302,521 B2
(45) Date of Patent: Apr. 5, 2016

(54) ADJUSTABLE STENCIL FOR PAINTING PARKING LOTS

(71) Applicant: Travis Bennett, Fort Worth, TX (US)

(72) Inventor: Travis Bennett, Fort Worth, TX (US)

(73) Assignee: Simple Stripe Solutions, LLC, Fort Worth, TX (US)

( * ) Notice: Subject to any disclaimer, the term of this patent is extended or adjusted under 35 U.S.C. 154(b) by 150 days.

(21) Appl. No.: 14/157,860

(22) Filed: Jan. 17, 2014

(65) Prior Publication Data

US 2014/0261028 A1 Sep. 18, 2014

Related U.S. Application Data

(60) Provisional application No. 61/788,175, filed on Mar. 15, 2013.

(51) Int. Cl.

| | |
|---|---|
| ***B41N 1/24*** | (2006.01) |
| ***B41L 13/02*** | (2006.01) |
| ***B44D 3/22*** | (2006.01) |
| ***B44D 2/00*** | (2006.01) |
| ***B05B 15/04*** | (2006.01) |
| ***B43L 13/20*** | (2006.01) |

(52) U.S. Cl.

CPC ..... *B41L 13/02* (2013.01); *B05B 15/0456* (2013.01); *B05B 15/0481* (2013.01); *B41N 1/248* (2013.01); *B43L 13/205* (2013.01); *B44D 2/007* (2013.01); *B44D 3/22* (2013.01)

(58) Field of Classification Search

CPC ..... B41F 15/44; B41F 15/46; B43L 13/205; B05B 15/045; B05B 15/0456; B05B 15/0481; B44D 3/22; B44D 3/225; B44D 2/007; B44D 2/002; G01B 3/00; G01B 3/14

USPC ..... 101/127; 434/87; 118/504; 144/144.51, 144/144.52; 409/130; 33/427, 454, DIG. 9, 33/566, 466, 464, 562, 563, 452, 456, 59, 33/60, 64

See application file for complete search history.

(56) References Cited

U.S. PATENT DOCUMENTS

| | | | | |
|---|---|---|---|---|
| 1,565,731 | A | 12/1925 | Girard | |
| 2,334,913 | A * | 11/1943 | Eisenberg | B26D 7/015 101/127 |
| 2,651,989 | A * | 9/1953 | Kerr | B05C 17/06 101/127 |
| 4,510,692 | A | 4/1985 | Overholser et al. | |
| 4,962,722 | A * | 10/1990 | Thompson | B05B 15/0475 118/504 |
| 5,342,447 | A * | 8/1994 | Nudo | B05B 15/0481 118/301 |
| 8,393,088 | B1 | 3/2013 | Palisano | |
| 2006/0102023 | A1 | 5/2006 | Rivera | |
| 2007/0095223 | A1 | 5/2007 | Cox et al. | |
| 2008/0092810 | A1 * | 4/2008 | Kim | B05C 21/005 118/504 |
| 2010/0126416 | A1 * | 5/2010 | Gringer | B05B 15/0475 118/504 |
| 2010/0153311 | A1 | 6/2010 | McCormick | |

* cited by examiner

*Primary Examiner* — Leslie J Evanisko
(74) *Attorney, Agent, or Firm* — James E. Walton

(57) ABSTRACT

An adjustable stencil for painting parking lots. The adjustable stencil enables parking lot painters adjust the stencil for painting lines, stripes, boxes, and arrows on parking lots.

13 Claims, 7 Drawing Sheets

ADJUSTABLE STENCIL FOR PAINTING PARKING LOTS

This application claims the benefit of U.S. Provisional Patent Application No. 61/788,175 filed 15 Mar. 2013, titled "ADJUSTABLE STENCIL FOR PAINTING PARKING LOTS," which is hereby incorporated by reference for all purposes as if fully set forth herein.

BACKGROUND

1. Field of the Invention

The present invention relates in general to the field of stencils for parking lot markings.

2. Description of Related Art

The making of a stencil has long been the preferred method of marking a surface by using the projected cut out idea, transferred onto a thin sheet of material, be it paper, plastic, metal etc. Users can then place the stencil on any number of surfaces and create the desired design by applying some sort of pigment. This method has undergone a variety of changes from simple transference of tribal signs to that of more elaborate family crest. The distinguishing of men on the battlefield was often done by stenciling the sign of the kingdom to shields and clothing, because of its ease of transference. But as the science of stenciling developed, so too did its forms and importance. Stencils have played some very important roles in the development of our shared history. The story is told of the young Johann Gutenberg, who entered the shop of his father and by accident, dropped a carved wooden letter into a bucket of pigmented liquid. He quickly retrieved it from the liquid and placed it on a surface to dry. Later when he moved the letter he noticed the impression left, and thus a stencil was marked in the mind of the man who would bring the world out of the age of the quill to the science of immoveable type. During the great wars in Europe, the training of airplane pilots to be accurate in bomb dropping was marked on the pretended field of battle by a large stenciled X, thus giving the pilot a viewable target from above. This type of stenciling is more in line with the application being presented, i.e., on the ground. Not simply the marking of personal items, but rather the stenciling of shared space. With the rise and expansion of cities, and thus the need for directional development, an ever increasing system of surface applications has become necessary. If one can mark a field, one then directs an ever expanding mass of transit by applying necessary information to the varied surfaces upon which they transverse. Thus parking lot striping allows the public to maintain order and share common spaces with safety. It has become necessary in the course of development to stencil certain spaces for those among us who suffer with some type of disability. Their preferred parking places have become the universal symbol for safety and preference. The need has also arisen for the shared space of transit to be marked with certain directional arrows, allowing for the ease of flow and the lessening of accidents and congestion. And with the rise of the modern fast food restaurant such pavement markings have taken on a life of their own. Entire packages of logos and local or regional fixed stencils exist to give the driver a since of local shared identity. Thus we see an every widening array of products filling the market to meet the needs of our ever changing transit experience.

There is a certain sense of excitement as a new business moves into a neighborhood. The new architecture, and clean curb appeal make for the ever increasing value of that neighborhood. However certain problems do exist for the owners of such business. One being that which this application addresses. Sadly the pavement marking industry, which has no problem in creating accurate zoned new construction fixed markings, stumbles in the later maintenance and care for such directional's. Here is the problem. Suppose an initial striper enters the parking lot striping industry. The initial striper then must make certain choices as to the font and sizes of lettering for such things as DRIVE THRU, ENTER, EXIT, ONLY, LOADING ZONE, ETC. The initial striper must also decide on a size of arrow for giving direction to the initial striper's customers. Such arrows vary from as little as 6" to the ever sprawling 92". Also the handicap marking for such business must be done in compliance with the ADA, usually requiring the initial striper to stencil a large blue box overlaid with a white wheelchair symbol. Finally, the initial striper completes the striping of the parking lot, and move on to the next job. The problem arises when the new striper follows the initial striper and tries to perform general maintenance in re-striping the parking lot. If the new striper has not chosen the same size of fixed stencils, arrows or, boxes, the new striper must make certain adjustments to the initial striper preexisting sizes. Thus over years of parking lot maintenance restriping various users have seen something that looked so easy, become an ever sprawling metamorphosis of dysfunction. Stripers have not always had the same font style or stencil size as the initial striper before them, and so users have only one option afforded to them in the course of performing their maintenance tasks. Paint a box over the existing stenciling and then apply a larger size stencil using another color. It's a common practice. This then becomes the pattern for those who follow the new striper, except they never are able to cover the new striper's square or arrow cleanly and accurately. It continues to get ever larger and larger. Or in the case of the arrows, they simply get a paint over, which leaves the old arrow, peering and poking out from under the new one. Most use a makeshift elaboration of boards, tape, paint paddles, etc. to try and maintain the size of the box or arrow, as the ability to mimic the same size is elusive. Thus the need to have an adjustable stencil for arrows, boxes, parking bumps, and lighting poles has led to the creation of just such a product.

While there are many stencils for painting parkings lot well known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
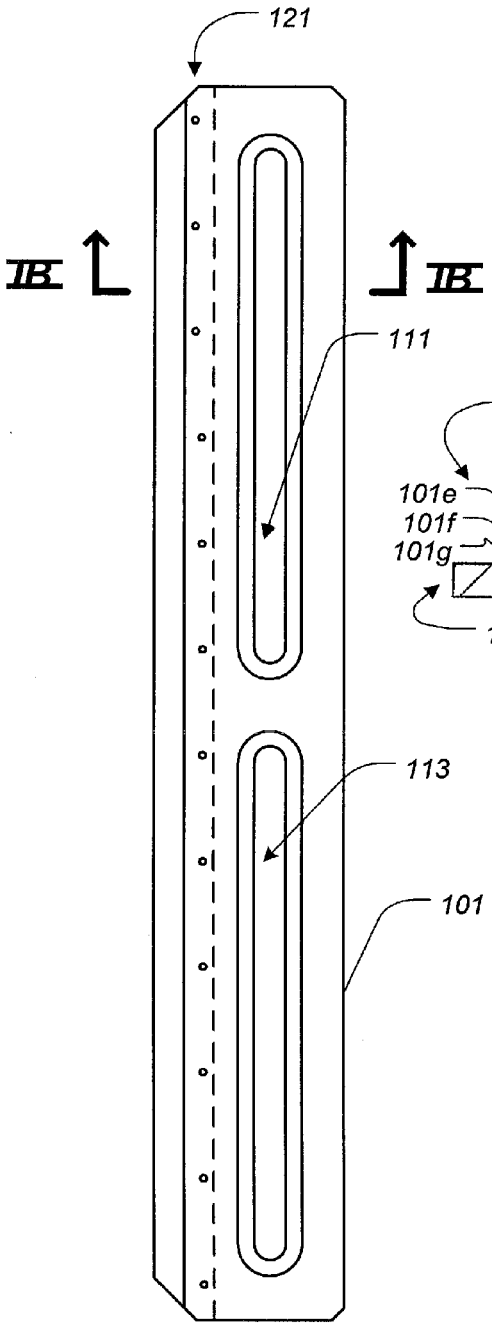
FIG. 1A is a plan view of a preferred embodiment of an adjustable stencil for painting parking lots according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the adjustable stencil assembly and method are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The assembly is comprised of a series of stencils that allow the parking lot striper the ability to save time and resources by adjusting the arrow, box, bump, or pole application as needed, thus mimicking the size and stopping the sprawl. The fixed stencil industry is in need of a device that is both functional and efficient. With the creation of an adjustable stencil, a user can go as small or as large as needed, but keeping the original template intact.

The ability to adjust to the maintenance application needed is fast and easy with just the twist of a few T-knobs and the positioning of the adjustable paddles. The fixed stencil industry has not been relegated and as such has been found inefficient and wooden in its approach to directional stencil signage. With this device a user can remedy the frustration of the owner, community, and striper by keeping the original context as close to its original application as possible.

The adjustable Arrow, Square, and Bump stencils all consist of an elongated trunk which is mated with an elongated paddle. It is fixed with a handle in the middle separating the two routed or slotted vents. These are then screwed together. They affix together in a basic shape, such as an Arrow, Square or Rectangle, with Carriage bolts, washers and T-knobs. The Circle, follows the same trunk affixed to the paddle but is cut into two equal halves. It is also screwed together at the base, from the bottom into the top trunk.

Referring to FIG. 1A, a plan view of a preferred embodiment of an adjustable stencil for painting parking lots according to the present application is illustrated. The stencil is assembled from a series of trunks 101 or members. Trunk 101 is typically fabricated from a non-porous material such as high density plastic. Because the trunk 101 is exposed to various paints and chemicals it needs to be non-reactive. Trunk 101 is made from a single piece and includes a series of slotted vents 111 and 113 parallel to the length of the trunk 101. Slotted vents 111 and 113 are designed to allow users to interconnect a plurality of trunks together to shape a stencil. While it is shown that there are two slotted vents in the trunk, it should be apparent that a single slotted vent or alternatively more slotted vents are possible. Along an edge of the trunk is a fastening means for securing a paddle (not shown). Typically the fastening means are a series of evenly spaced screws 121. Screws 121 are designed to be recessed into the trunk 101 so that the top of the trunk 101 is flush or uniform without screw heads protruding from the upper surface of the trunk 101.

Figure 1B:
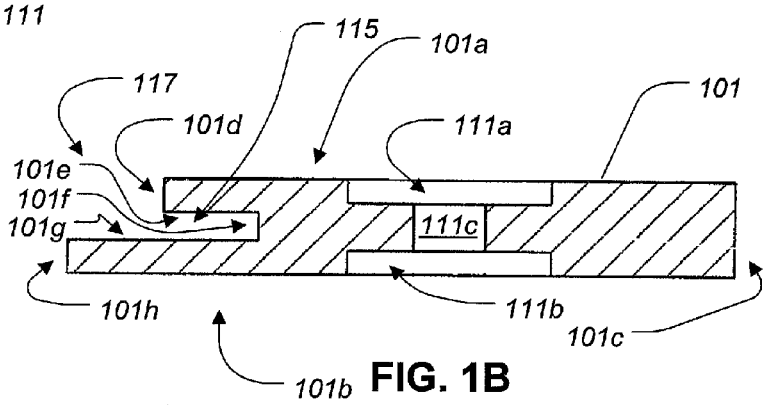
FIG. 1B is a partial cross-sectional view of the adjustable stencil for painting parking lots of FIG. 1A taken at IB-IB in FIG. 1A according to the present application.

Referring now also to FIG. 1B, a partial cross-sectional view of the adjustable stencil for painting parking lots of FIG. 1A taken at IB-IB in FIG. 1A according to the present application is illustrated. Trunk 101 includes an upper surface 101*a*, a lower surface 101*b*, an outboard surface 101*c*, and inboard surfaces 101*d*-101*h*. Inboard surfaces 101*d*-101*h* are typically made from cutting a slot 115 and a corner 117 into the length of the trunk 101. Slot 115 allows a paddle (not shown) to mechanically couple to the trunk 101. It should be apparent that the slot 115 could be grooved to provide greater mechanical coupling strength to reduce the chance the paddle (not shown) can be inadvertently removed.

The slotted vent 111 located in trunk 101 includes three regions. First slot 111*a* is located near the upper surface of the trunk 101 and only goes to a certain depth in the trunk 101. Second slot 111*b* is located near the lower surface of the trunk 101 and only goes to a certain height in the trunk 101. The third slot 111*c* connects the first slot 111*a* and the second slot 111*b* and provides an opening though the trunk 101. Slots 111*a* and 111*b* allow the fasteners between different paddles to remain flush.

Figure 2:
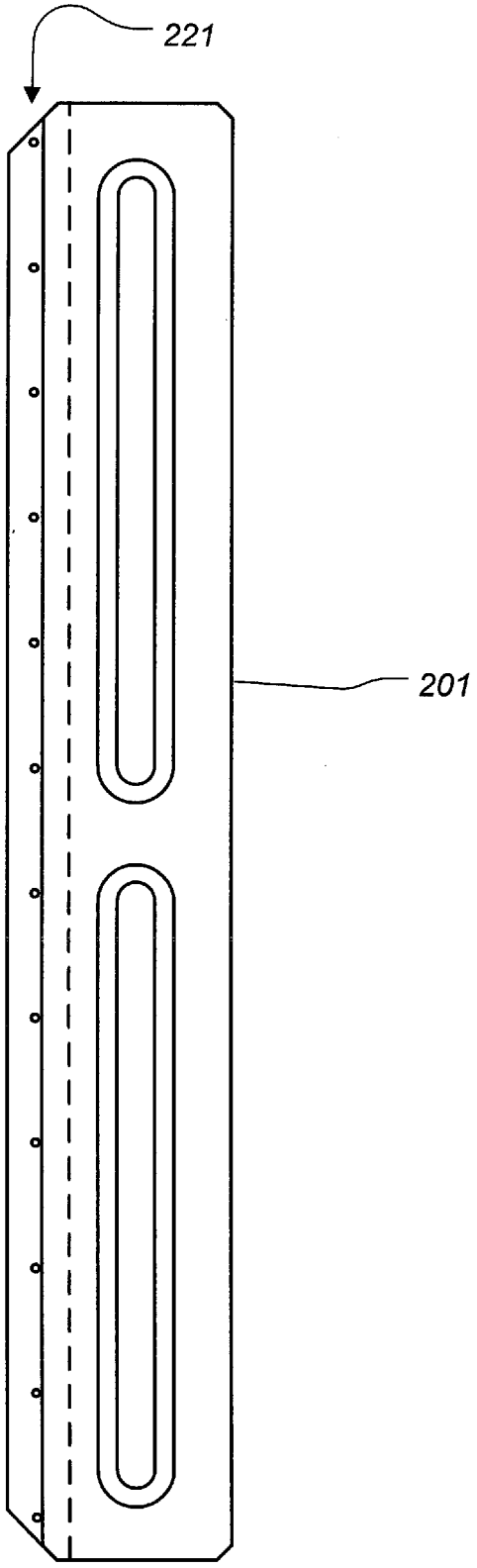
FIG. 2 is a plan view of an alternative embodiment of an adjustable stencil for painting parking lots according to the present application.

Referring now also to FIG. 2, a plan view of an alternative embodiment of an adjustable stencil for painting parking lots according to the present application is illustrated. Trunk 201 is very similar to trunk 101, however the screws 221 are shifted more inboard so that the screws 221 go through the paddle (not shown) into the trunk 201. Moving the screws 221 provides a smoother upper or top surface of the trunk 201.

Figure 3A:
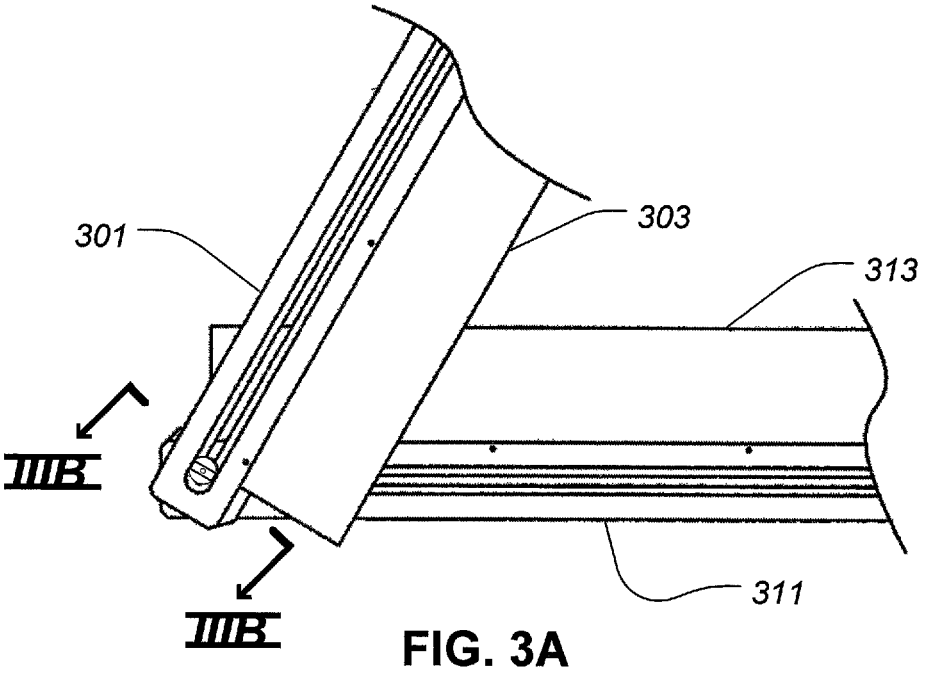
FIG. 3A is a partial plan view of a preferred embodiment of an assembled adjustable stencil for painting parking lots according to the present application.

Referring now also to FIG. 3A, a partial plan view of a preferred embodiment of an assembled adjustable stencil for painting parking lots according to the present application is illustrated. Coupled to trunk 301 is paddle 303. Paddle 303 is made of plastic or rubber and is designed to provide flexibility to the stencil, thereby allowing the stencil to adjust to the surface irregularities of the parking lot. Users of the stencil can remove the paddle 303 from the trunk 301 and replace it as it becomes brittle with age or is too coated with paint to flex. Coupled to trunk 311 is paddle 313. Trunk 301 is mechanically coupled to trunk 311 to form an acute angle. The mechanical coupling is accomplished by use of a carriage bolt, a series of washers, and a t-nut. An alternative embodiment uses a handle with a nut located inside the handle for tool less tightening and loosening of the nut. The t-nut allows a user to quickly adjust the friction between trunk 301 and trunk 311. Therefore, the user can adjust the angle between the two trunks and prevent relative motion between the two trunks.

Figure 3B:
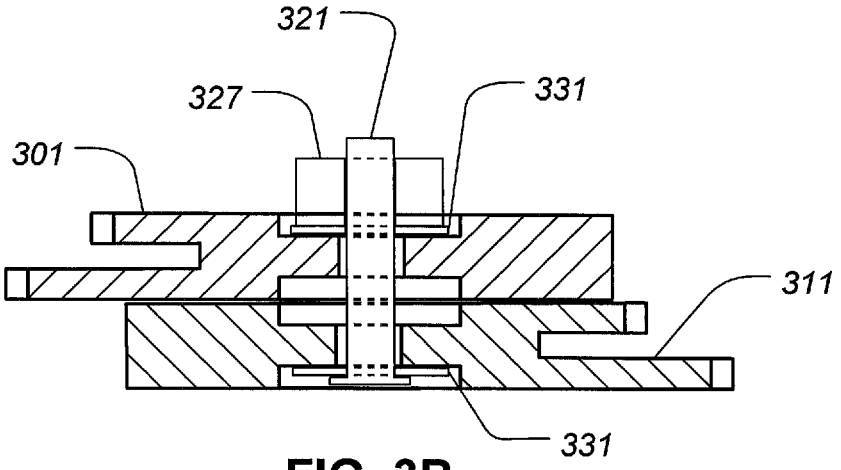
FIG. 3B is a partial cross-sectional view of the assembled adjustable stencil for painting parking lots of FIG. 3A taken at IIIB-IIIB in FIG. 3A according to the present application.

Referring now also to FIG. 3B, a partial cross-sectional view of the assembled adjustable stencil for painting parking lots of FIG. 3A taken at IIIB-IIIB in FIG. 3A according to the present application is illustrated. Carriage bolt 321 is located in the slotted vents of trunk 301 and trunk 311. While a carriage bolt is shown, it should be apparent that other types of fasteners may be used to mechanically couple trunk 301 to trunk 311. A t-nut 327 is used to secure the carriage bolt 321 to the trunks. It should be apparent that other types of fasteners are useable in place of the t-nut 327 or a t-knob. The use of a t-nut 327 provides the user with a tool less option to adjust the angle between the trunks without having to use a tool like a wrench. Another alternative to the t-nut 327 is a handle with an embedded nut. Washers 331 are used between the carriage bolt 321 and the trunk 311 along with between the t-nut 327. Furthermore, it should be apparent that the washers 331 could have a locking function to increase friction and reduce the chance that the trunks loosen up.

Figure 4A:
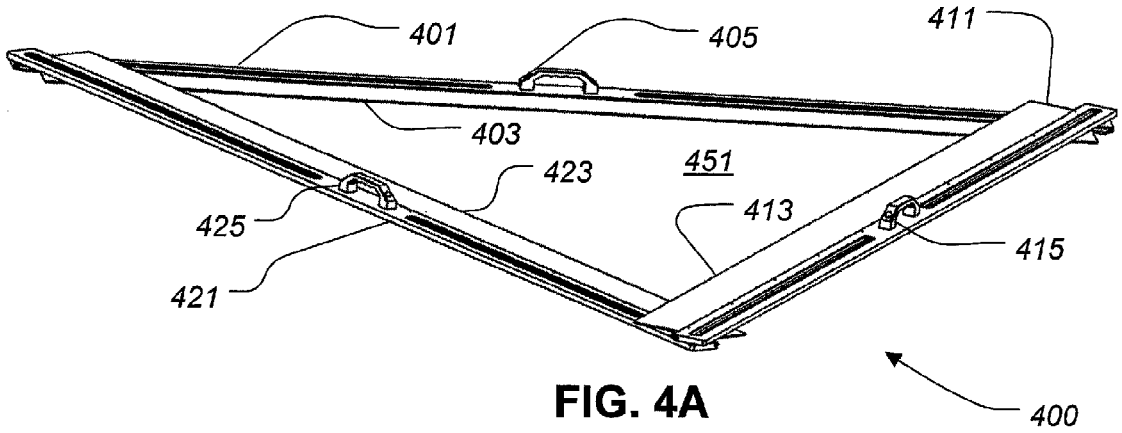
FIG. 4A is a perspective view of a preferred embodiment of a triangular assembled adjustable stencil for painting parking lots according to the present application.

Referring now also to FIG. 4A, a perspective view of a preferred embodiment of a triangular assembled adjustable stencil for painting parking lots according to the present application is illustrated. The any arrow or triangular shaped stencil 400 is formed by combining three trunks 401, 411, and 421. Trunk 401 includes a paddle 403 and a handle 405. Paddle 403 or mask in alternative embodiments is disposable so that the user can readily replace the paddle as it is covered in paint and becomes too inflexible or irregularly shaped to mask a straight line. Handle 405 is shown above the stencil; however other embodiments have a recessed handle to facilitate sliding one trunk over anther trunk to adjust the shape. Trunk 411 includes a paddle 413 and a handle 415. Trunk 421 includes a paddle 423 and a handle 425. It should be apparent that handle 425 is attached to trunk 421 by fasteners and allows the user to adjust and control the trunk 421. While the mechanical couplings have not been shown for clarity purposes, the trunks are attached by using carriage bolts, t-nuts, and washers.

Figure 4B:
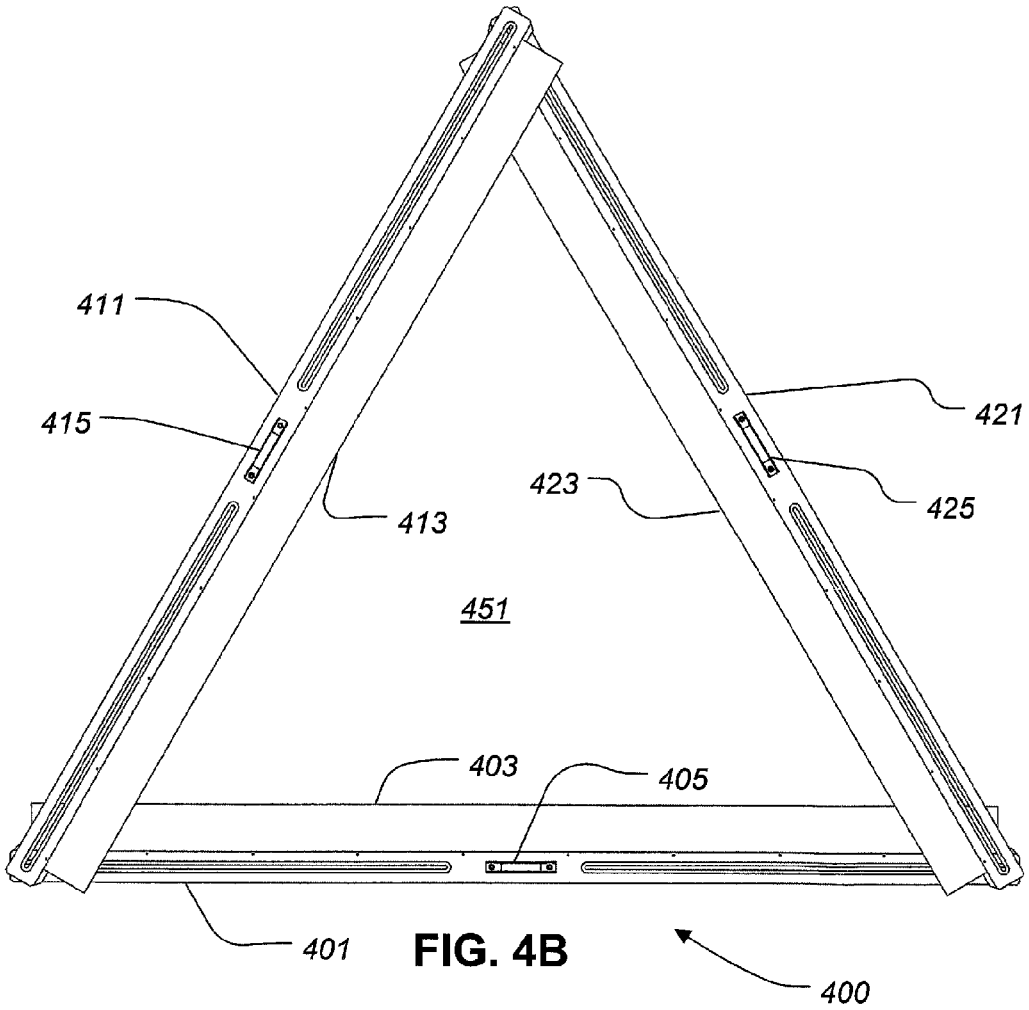
FIG. 4B is a plan view of a preferred embodiment of a triangular assembled adjustable stencil for painting parking lots according to the present application.

Referring now also to FIG. 4B, a plan view of a preferred embodiment of a triangular assembled adjustable stencil for painting parking lots according to the present application is illustrated. Trunks 401, 411, and 421 are arranged by the user to create a triangular region 451. Paddle 423 overlaps paddle 403 and paddle 413. The user then applies paint in the triangular region 451 to paint a triangle. While the mechanical couplings have not been shown for clarity purposes, the trunks are attached by using carriage bolts, t-nuts, and washers.

For assembling the "Any Arrow" the user should do the following. First lay the three elongated trunk pieces side by side. Next place them in the shape desired, a triangle for an arrow. Then make sure the paddle sides are facing inward toward each other. Make sure the handle is facing upward. Then place the top of one on the top of the other, connecting them at the top most parts. Next take the carriage bolt and washer and place them in the aligned slotted vent. As the bolt protrudes through both trunks, place the second washer on the threaded extended portion and secure it with the supplied T-knob. This should have given the user the appearance of an inverted V. Next place the elongated trunk piece on the top, but at the bottom of the piece to the user's right. Make sure the paddle sides are facing inward toward each other. Make sure the handle is facing upward. Take the carriage bolt and washer and place them in the aligned slotted vent. As the bolt protrudes through both trunks, place the second washer on the threaded extended portion and secure it with the supplied T-knob. Next place the remaining unconnected pieces together. It is important to make sure the remaining trunk pieces just fastened are placed under the first trunk piece on the left. Make sure the paddle sides are facing inward toward each other. Make sure the handle is facing upward. Take the carriage bolt and washer and place them in the aligned slotted vent. As the bolt protrudes through both trunks, place the second washer on the threaded extended portion and secure it with the supplied T-knob. This should give the appearance of a triangle.

Figure 5A:
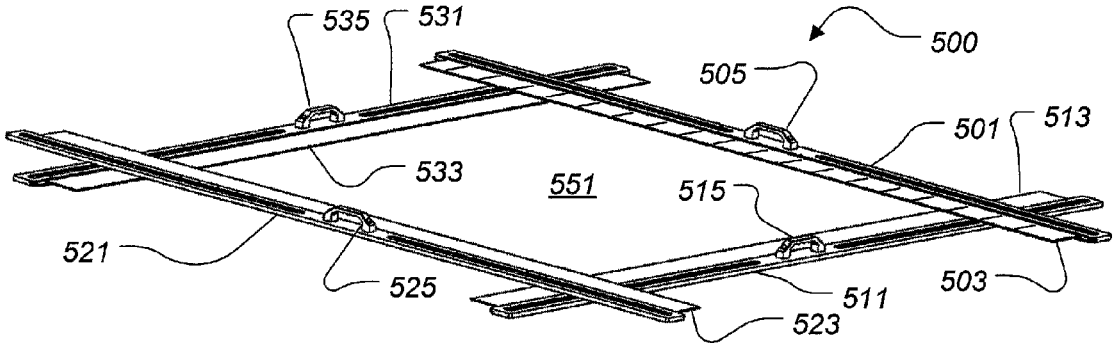
FIG. 5A is a perspective view of a preferred embodiment of a square shaped assembled adjustable stencil for painting parking lots according to the present application.

Referring now to FIG. 5A, a perspective view of a preferred embodiment of a square shaped assembled adjustable stencil for painting parking lots according to the present application is illustrated. The "any square" or square shaped stencil 500 is formed by combining four trunks 501, 511, 521, and 531. First trunk 501 includes a flexible rubber paddle 503 along with a handle 505. Second trunk 511 includes a flexible rubber paddle 513 along with a handle 515. Third trunk 521 includes a flexible rubber paddle 523 along with a handle 525. Forth trunk 531 includes a flexible rubber paddle 533 along with a handle 535. While the mechanical couplings have not been shown for clarity purposes, the trunks are attached by using carriage bolts, t-nuts, and washers. Trunk 501 includes a graduated scale 507 located on paddle 503. Graduated scale 507 as illustrated is a series of evenly spaced indicators. The indicators could be grooves, lines, ridges, with and without numerical references. The graduated scale 507 allows users to keep the trunks parallel or square without having to resort to measure the distance or angle between the paddles. While it is shown that only one trunk 501 of "Any Square" stencil 500 has the graduated scale 507 it should be apparent that any of the trunks described here could feature embedded references to assist the painters.

Figure 5B:
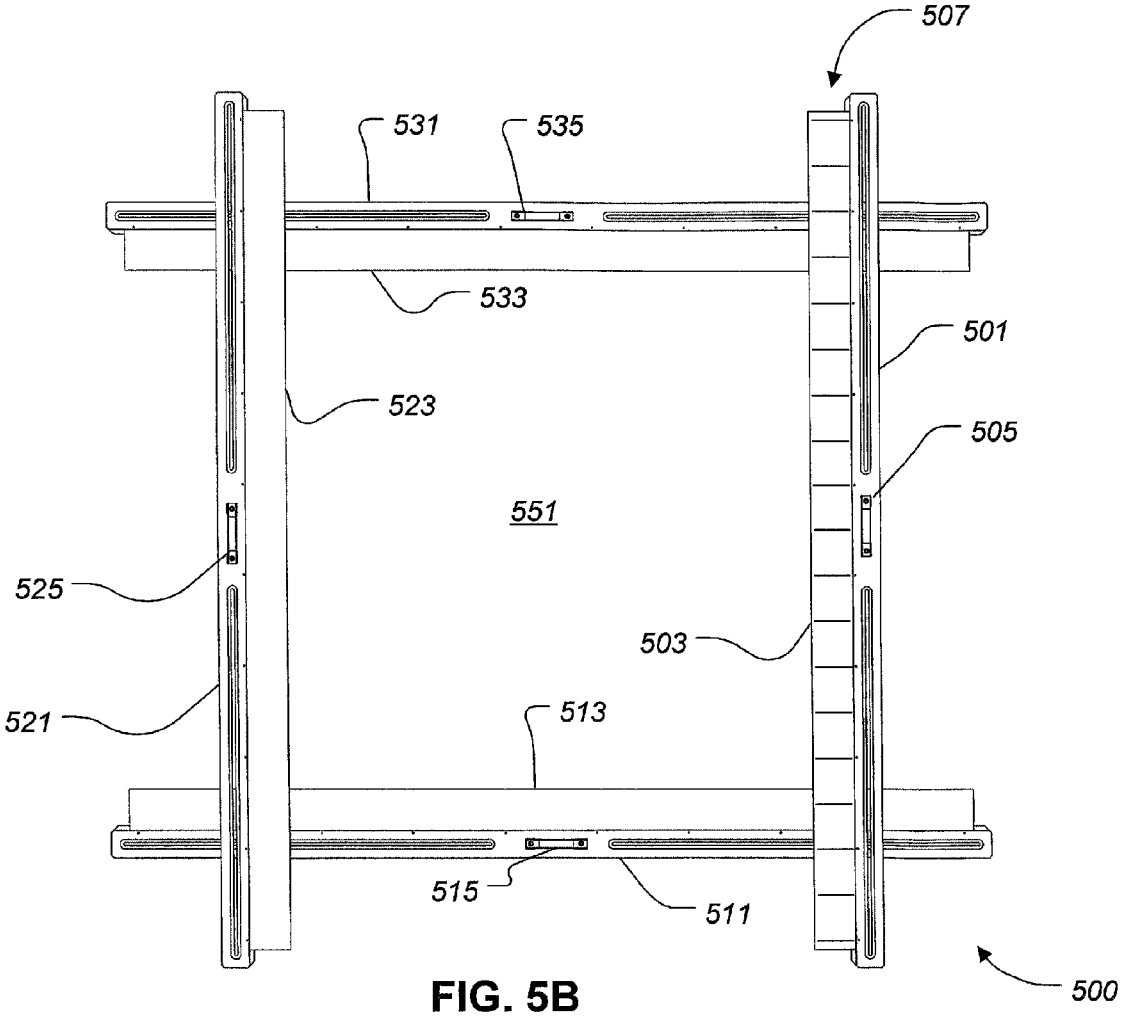
FIG. 5B is a plan view of a preferred embodiment of a square shaped assembled adjustable stencil for painting parking lots according to the present application.

Referring now to FIG. 5B, a plan view of a preferred embodiment of a square shaped assembled adjustable stencil for painting parking lots according to the present application is illustrated. Trunks 501, 511, 521, and 531 are arranged by the user to create a square region 551. The user then applies paint in the square region 551 to paint a square. While the mechanical couplings have not been shown for clarity purposes, the trunks are attached by using carriage bolts, t-nuts, and washers.

For assembling the "Any Square" the user should do the following. First lay the four elongated trunk pieces side by side. Then make sure the paddle sides are facing inward toward each other. Make sure the handle is facing upward. Then place the top of one on the top of the other, connecting them at the top most parts. Next take the carriage bolt and washer and place them in the aligned slotted vent. As the bolt protrudes through both trunks, place the second washer on the threaded extended portion and secure it with the supplied T-knob. This should have given the user the appearance of an inverted V. Next place the elongated trunk piece on the top, but at the bottom of the piece to the user's right. Make sure the paddle sides are facing inward toward each other. Make sure the handle is facing upward. Take the carriage bolt and washer and place them in the aligned slotted vent. As the bolt protrudes through both trunks, place the second washer on the threaded extended portion and secure it with the supplied T-knob. Next place the remaining unconnected pieces together. It is important to make sure the remaining trunk pieces just fastened are placed under the first trunk piece on the left. Make sure the paddle sides are facing inward toward each other. Make sure the handle is facing upward. Take the carriage bolt and washer and place them in the aligned slotted vent. As the bolt protrudes through both trunks, place the second washer on the threaded extended portion and secure it with the supplied T-knob. Since the user is making the square repeat the process one more time, making sure the right trunk piece is on top of the last one fastened, but underneath the remaining unsecured trunk. Make sure the paddle sides are facing inward toward each other. Make sure the handle is facing upward. This should give the appearance of a square.

Typically, the user would find an existing painted square on a parking lot needing repainting. The user would take four trunks and position them so the paddles are facing inwards. The user would position or locate the paddles to just outside the existing painted square. The user would then start securing the first trunk to the second adjacent trunk through the use of fasteners and washers. The user would then continue securing further trunks to the assembly until all the trunks surrounding the existing painted square are secured. The user might have to reposition the paddles to insure proper placement as the stencil is assembled around the existing painted square. The user then can apply paint inside the paddles to repaint the existing painted square. Additionally, it should be apparent that the number of trunks to be used can be adjusted to match the number of sides of the shape to be painted. For example, if a six sided shape was desired, then six different trunks with paddles are used.

Figure 6A:
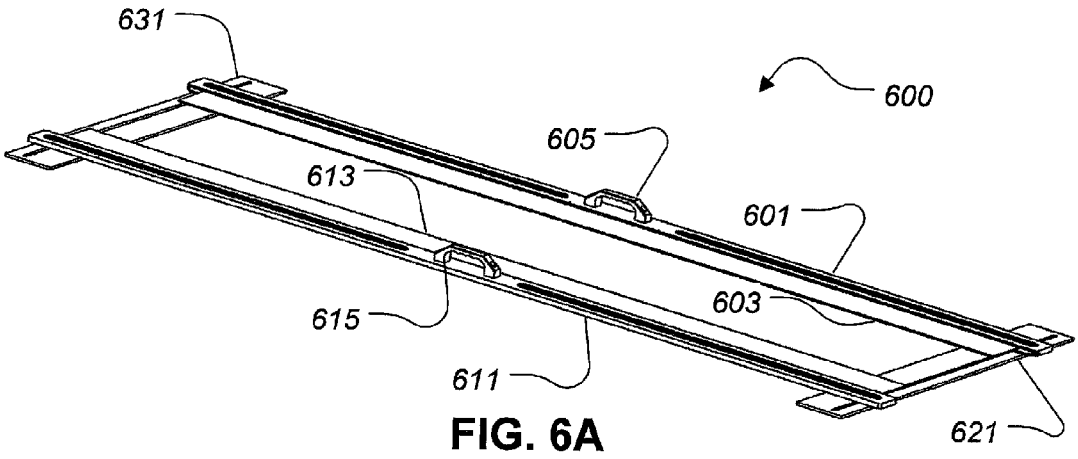
FIG. 6A is a perspective view of a preferred embodiment of a rectangular assembled adjustable stencil for painting parking lots according to the present application.
Figure 6B:
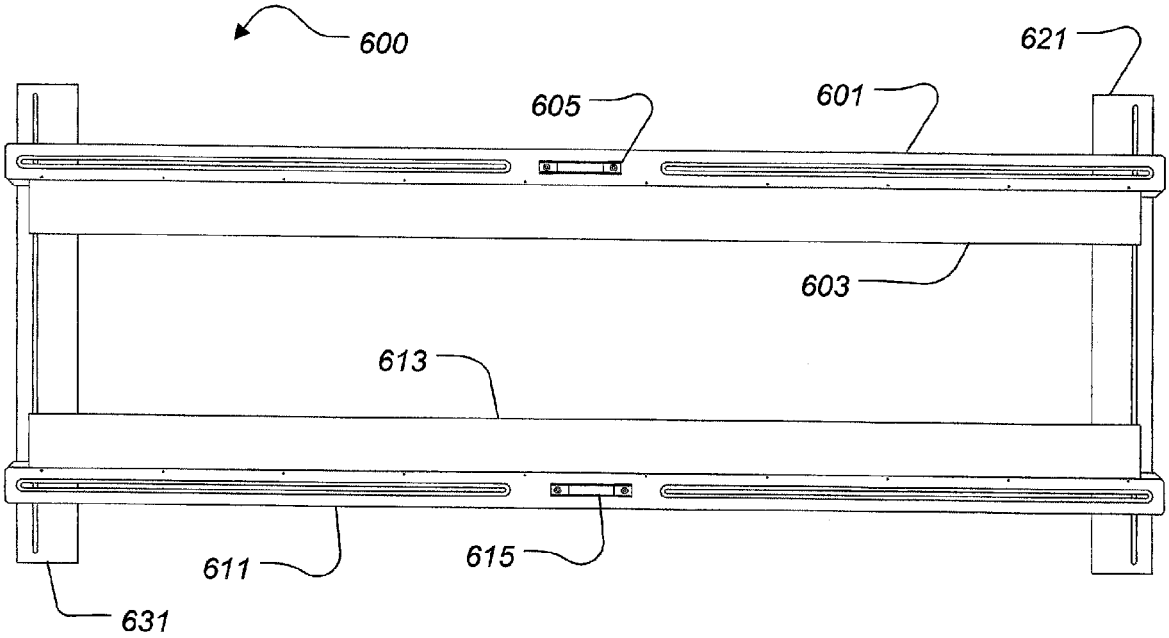
FIG. 6B is a plan view of a preferred embodiment of a rectangular assembled adjustable stencil for painting parking lots according to the present application.

Referring now also to FIG. 6A, a perspective view of a preferred embodiment of a rectangular assembled adjustable stencil for painting parking lots according to the present application, as well as, to FIG. 6B a plan view of a preferred embodiment of a rectangular assembled adjustable stencil for painting parking lots according to the present application are illustrated. The rectangular stencil 600 or "Any Bump" is suitable for painting rectangles, quadrilaterals, and rectangular shaped objects such as speed bumps in parking lots. The stencil 600 includes an elongated first trunk 601, an elongated second trunk 611, a third trunk 621, and a fourth trunk 631. First trunk 601 includes a flexible rubber paddle 603 along with a handle 605. Second trunk 611 includes a flexible rubber paddle 613 along with a handle 615. While the assembly is shown without paddles and handles on the third and fourth trunks it should be apparent that they could be added to the stencil. While the mechanical couplings have not been shown for clarity purposes, the trunks are attached by using carriage bolts, t-nuts, and washers.

Assembling the "Any Bump" is as follows. First lay the two elongated trunk pieces along with the smaller trunk pieces in a row. Take the two longer trunk pieces and place them parallel horizontal to each other. Make sure the paddle side is facing inward. Make sure the handle side is up. Next place the smaller trunk piece under the right side of the top trunk piece toward the farthest right part. Make sure the paddle is facing inward. Take the carriage bolt and washer and place them in the aligned slotted vent. As the bolt protrudes through both trunks, place the second washer on the threaded extended portion and secure it with the supplied T-knob. This should give the appearance of a horizontal L. Next place the smaller trunk piece under the left side of the top longer top trunk piece. Make sure the paddle is facing inward. Take the carriage bolt and washer and place them in the aligned slotted vent. As the bolt protrudes through both trunks, place the second washer on the threaded extended portion and secure it with the supplied T-knob. Repeat this process on the remaining bottom left top trunk laying on the smaller trunk piece. This should give the appearance of an L. Make sure the paddle is facing inward. Take the carriage bolt and washer and place them in the aligned slotted vent. As the bolt protrudes through both trunks, place the second washer on the threaded extended portion and secure it with the supplied T-knob. Next repeat the process on the bottom right bottom trunk laying on the smaller trunk piece. Make sure the paddle is facing inward. Take the carriage bolt and washer and place them in the aligned slotted vent. As the bolt protrudes through both trunks, place the second washer on the threaded extended portion and secure it with the supplied T-knob.

Figure 7A:
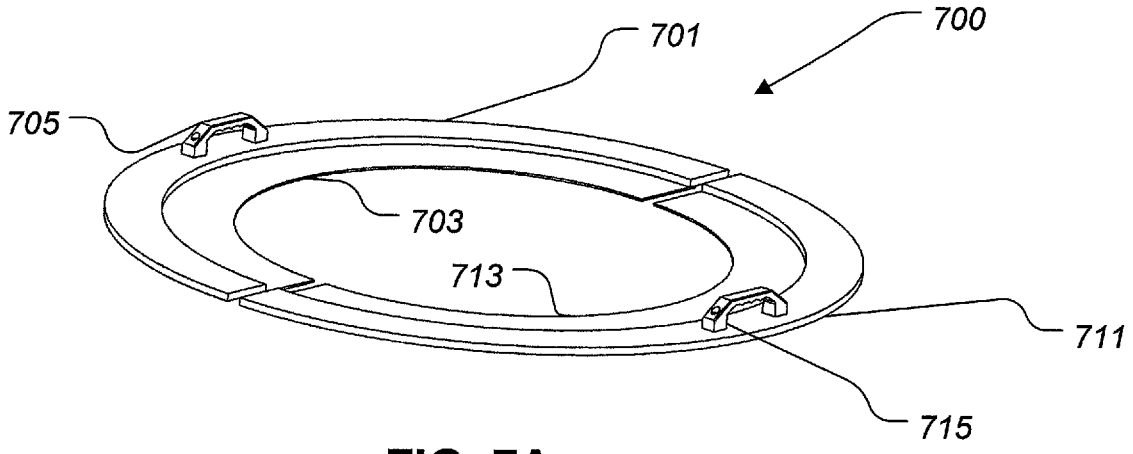
FIG. 7A is a perspective view of a preferred embodiment of a circular assembled adjustable stencil for painting parking lots according to the present application.

Referring now also to FIG. 7A, a perspective view of a preferred embodiment of a circular assembled adjustable stencil for painting parking lots according to the present application is illustrated. The "Any Pole" or circular stencil 700 is designed for masking out a circle, such as around a light pole base. Trunk 701 in combination with trunk 711 is designed to paint circular shaped areas of parking lots such as around a concrete base for a lamp. Paddle 703 is attached to trunk 701 through use of fasteners attached to the trunk 701 from the underside of the stencil. Additionally, trunk 701 includes a handle 705 to ease adjustment of the paddle relative to the other half of the stencil and to the parking lot. Paddle 713 is attached to trunk 711 through use of fasteners attached to the trunk 711 from the underside of the stencil. Additionally, trunk 711 includes a handle 715 to ease adjustment of the paddle relative to the other half of the stencil and to the parking lot.

Figure 7B:
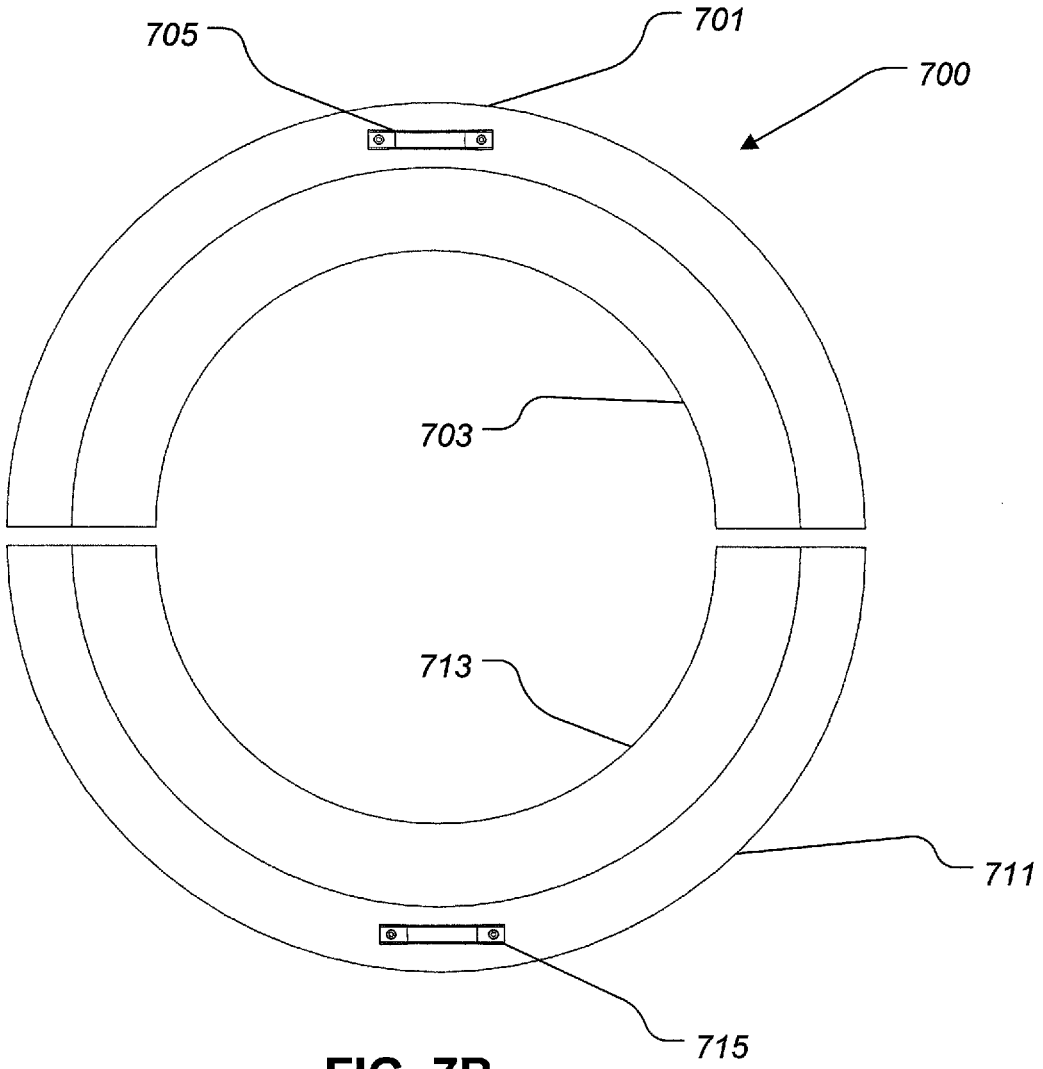
FIG. 7B is a plan view of a preferred embodiment of a circular assembled adjustable stencil for painting parking lots according to the present application.

Referring now also to FIG. 7B, a plan view of a preferred embodiment of a circular assembled adjustable stencil for painting parking lots according to the present application is illustrated. Because the diameter of the stencil is not readily adjustable, a user would have a variety of various "Any Pole" stencils to be able to paint around a variety of poles and circular concrete mounts.

The "Any Pole" comes assembled. The circular stencil is able to fit the pole base by simply aligning the two pieces together. Make sure the paddle portions are facing inward. If adjustment is needed on the pole this can be achieved by rotation of the stencil. Making sure that the inmost surface of the circle is touching the pole base.

It is apparent that an assembly and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An adjustable stencil for painting parking lots comprising:

a first flexible paddle; and a first trunk for securing the first flexible paddle comprising:

a longitudinal opening; and a groove configured for receiving the first flexible paddle; and a plurality of fasteners for securing the first flexible paddle to the first trunk;

a second flexible paddle;

a second trunk for securing the second flexible paddle comprising:
a longitudinal opening; and
a groove configured for securing the second flexible paddle; and
a third flexible paddle;
a third trunk for securing the third flexible paddle comprising:
a longitudinal opening; and
a groove configured for securing the third flexible paddle;
a fourth flexible paddle;
a fourth trunk for securing the fourth flexible paddle comprising:
a longitudinal opening; and
a groove configured for securing the fourth flexible paddle;
a first fastener system;
a second fastener system;
a third fastener system; and
a fourth fastener system;
wherein the first fastener system is configured to secure the first trunk to the second trunk through the longitudinal opening of the first trunk and through the longitudinal opening of the second trunk;
wherein the second fastener system is configured to secure the third trunk to the second trunk through the longitudinal opening of the third trunk and through the longitudinal opening of the second trunk;
wherein the third fastener system is configured to secure the third trunk to the fourth trunk through the longitudinal opening of the third trunk and through the longitudinal opening of the fourth trunk; and
wherein the fourth fastener system is configured to secure the fourth trunk to the first trunk through the longitudinal opening of the fourth trunk and through the longitudinal opening of the first trunk, thereby forming a quadrilateral shape.

2. The adjustable stencil of claim 1, wherein each of the first, second, third, and fourth fastener systems further comprises:
a carriage bolt;
a plurality of washers; and
a t-nut.

3. The adjustable stencil of claim 2, wherein each of the first, second, third and fourth fastener systems can be tightened and loosened without tools.

4. The adjustable stencil of claim 1, wherein the plurality of fasteners are located on an upper surface of the first flexible paddle.

5. An adjustable stencil for painting parking lots comprising:
a first flexible paddle; and
a first trunk for securing the first flexible paddle comprising:
a longitudinal opening; and
a groove configured for receiving the first flexible paddle; and
a plurality of fasteners for securing the first flexible paddle to the first trunk;
a second flexible paddle;
a second trunk for securing the second flexible paddle comprising:
a longitudinal opening; and
a groove configured for securing the second flexible paddle; and
a third flexible paddle;
a third trunk for securing the third flexible paddle comprising:
a longitudinal opening; and
a groove configured for securing the third flexible paddle;
a first fastener system;
a second fastener system; and
a third fastener system;
wherein the first fastener system is configured to secure the first trunk to the second trunk through the longitudinal opening of the first trunk and through the longitudinal opening of the second trunk;
wherein the second fastener system is configured to secure the third trunk to the second trunk through the longitudinal opening of the third trunk and through the longitudinal opening of the second trunk; and
wherein the third fastener system is configured to secure third trunk to the first trunk through the longitudinal opening of the third trunk and through the longitudinal opening of the first trunk, thereby forming a three-sided triangular shape.

6. An adjustable stencil for painting parking lots, comprising:
a first paddle;
a first member for holding the first paddle having:
an upper surface;
a lower surface;
an inner surface with a channel for receiving the first paddle;
an outer surface;
an elongated opening through the first member, and
a first fastener for coupling the first paddle to the first member;
a second paddle;
a second member for holding the second paddle having:
an upper surface;
a lower surface;
an inner surface with a channel for receiving the second paddle;
an outer surface;
an elongated opening through the second member;
a second fastener for coupling the second paddle to the second member;
a third paddle;
a third member for holding the third paddle having:
an upper surface;
a lower surface;
an inner surface with a channel for receiving the third paddle;
an outer surface;
an elongated opening through the third member;
a third fastener for coupling the third paddle to the third member;
a first fastener system for coupling the first member to the second member through the elongated opening of the first member and through the elongated opening of the second member;
a second fastener system for coupling the second member to the third member through the elongated opening of the second member and through the elongated opening of the third member; and
a third fastener system for coupling the third member to the first member through the elongated opening of the third member and through the elongated opening of the first member.

7. An adjustable stencil for painting parking lots, comprising:

a first paddle;

a first member for holding the first paddle having:

an upper surface;

a lower surface;

an inner surface with a channel for receiving the first paddle;

an outer surface;

an elongated opening through the first member, and a first fastener for coupling the first paddle to the first member a second paddle;

a second member for holding the second paddle having:

an upper surface;

a lower surface;

an inner surface with a channel for receiving the second paddle;

an outer surface;

an elongated opening through the second member;

a second fastener for coupling the second paddle to the second member;

a third member having an elongated opening through the third member;

a fourth member having an elongated opening through the fourth member;

a first fastener system for coupling the first member to the third member through the elongated opening of the first member and through the elongated opening of the third member;

a second fastener system for coupling the second member to the third member through the elongated opening of the second member and through the elongated opening of the third member;

a third fastener system for coupling the fourth member to the second member through the elongated opening of the fourth member and through the elongated opening of the second member; and a fourth fastener system for coupling the first member to the fourth member through the elongated opening of the first member and through the elongated opening of the fourth member.

8. The adjustable stencil of claim 7, wherein each of the first, second, third, and fourth fastener systems further comprises:

a carriage bolt;

a plurality of washers; and a t-nut.

9. The adjustable stencil of claim 8, wherein each of the first, second, third and fourth fastener systems can be tightened and loosened without tools.

10. The adjustable stencil of claim 7, wherein at least the first paddle is marked with a plurality of parallel lines.

11. The adjustable stencil of claim 7, wherein at least the first paddle is disposable.

12. The adjustable stencil of claim 7, wherein the first and second paddles are marked with a plurality of parallel lines to aid a user in squaring the stencil.

13. The adjustable stencil of claim 7, wherein the first fastener is located on an upper surface of the first paddle.

* * * * *